US008029391B2

(12) United States Patent
McNamee et al.

(10) Patent No.: US 8,029,391 B2
(45) Date of Patent: Oct. 4, 2011

(54) COMPOSITE BAT

(75) Inventors: Mark McNamee, Portland, OR (US); Chris S. Page, Portland, OR (US)

(73) Assignee: Nike, Inc., Beaverton, OR (US)

( * ) Notice: Subject to any disclaimer, the term of this patent is extended or adjusted under 35 U.S.C. 154(b) by 12 days.

(21) Appl. No.: 12/037,483

(22) Filed: Feb. 26, 2008

(65) Prior Publication Data

US 2009/0215560 A1 Aug. 27, 2009

(51) Int. Cl.
*A63B 59/06* (2006.01)

(52) U.S. Cl. ..... 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 4,848,745 | A * | 7/1989 | Bohannan et al. | 473/119 |
| 5,048,441 | A | 9/1991 | Quigley | |
| 5,114,144 | A | 5/1992 | Baum | |
| 5,301,940 | A | 4/1994 | Seki et al. | |
| 5,303,917 | A | 4/1994 | Uke | |
| 5,395,108 | A | 3/1995 | Souders et al. | |
| 5,458,330 | A | 10/1995 | Baum | |
| 5,460,369 | A | 10/1995 | Baum | |
| RE35,081 | E | 11/1995 | Quigley | |
| 5,533,723 | A | 7/1996 | Baum | |
| 5,624,115 | A | 4/1997 | Baum | |
| 5,722,908 | A | 3/1998 | Feeney et al. | |
| 5,865,696 | A | 2/1999 | Calapp et al. | |
| 6,056,655 | A | 5/2000 | Feeney et al. | |
| 6,152,840 | A | 11/2000 | Baum | |
| 6,274,230 | B1 | 8/2001 | Sarrelongue et al. | |
| 6,352,485 | B1 | 3/2002 | Philpot et al. | |
| 6,461,260 | B1 | 10/2002 | Higginbotham | |
| 6,475,580 | B1 | 11/2002 | Wright | |
| 6,497,631 | B1 | 12/2002 | Fritzke et al. | |
| 6,508,731 | B1 | 1/2003 | Feeney et al. | |
| 6,641,893 | B1 | 11/2003 | Suresh et al. | |
| 6,733,404 | B2 | 5/2004 | Fritzke et al. | |
| 6,761,653 | B1 * | 7/2004 | Higginbotham et al. | 473/566 |
| 6,776,735 | B1 | 8/2004 | Belanger et al. | |
| 6,969,330 | B1 | 11/2005 | Meeker | |
| 6,997,826 | B2 * | 2/2006 | Sutherland | 473/567 |
| 7,011,588 | B2 * | 3/2006 | Fritzke et al. | 473/567 |
| 7,033,291 | B1 | 4/2006 | Meeker | |
| 7,214,152 | B1 | 5/2007 | Vacek et al. | |
| 7,699,725 | B2 | 4/2010 | McNamee et al. | |
| 2002/0198071 | A1 * | 12/2002 | Snow | 473/564 |
| 2004/0029660 | A1 | 2/2004 | Chen et al. | |
| 2004/0209716 | A1 * | 10/2004 | Vacek et al. | 473/567 |
| 2005/0070384 | A1 * | 3/2005 | Fitzgerald et al. | 473/567 |
| 2006/0025249 | A1 | 2/2006 | Giannetti et al. | |
| 2006/0025253 | A1 | 2/2006 | Giannetti et al. | |
| 2007/0202974 | A1 | 8/2007 | Giannetti | |

* cited by examiner

*Primary Examiner* — Mark Graham
(74) *Attorney, Agent, or Firm* — Plumsea Law Group, LLC

(57) ABSTRACT

A bat includes a composite material barrel. The barrel includes a plurality of layers. A stiffening layer forms one of the exterior layers of the barrel. The stiffening layer includes unidirectional fibers, where the unidirectional fibers are oriented to substantially encircle the barrel. The stiffening layer is positioned on the barrel to cover at least a portion of the sweet zone. The barrel may include multiple walls, where each wall includes a stiffening layer.

13 Claims, 6 Drawing Sheets

COMPOSITE BAT

BACKGROUND OF THE INVENTION

1. Field of the Invention

The present invention relates generally to a composite bat. More specifically, the barrel of the composite bat has greater stiffness in the sweet zone due to a layer of axially oriented fibers.

2. Description of Related Art

Composite materials are commonly used for high performance bats in diamond sports, particularly in softball. While composite materials may be expensive, composite materials may offer some advantages over more traditional materials, such as wood and metal, in terms of targeted strength and weight management.

Of the materials typically used to construct bats, composite materials allow for the most design flexibility and customization. Composite materials or composites are materials made from two or more individual materials. Composite materials may be formed of fibers embedded in a matrix. For example, a carbon fiber resin matrix composite material is made of carbon fibers embedded within an epoxy resin matrix. The carbon fibers have a high toughness and are typically brittle. The toughness of a material refers to the ability of that material to resist fracture. The brittleness or ductility of a material refers to the tendency of that material to deform prior to fracture. The more brittle a material, the less that material deforms prior to fracture. The more ductile a material, the more that material deforms prior to fracture. Most matrix materials tend to be ductile but not very tough. In other words, longitudinal stiffness, moment of inertia, mass, and center of gravity may be more precisely controlled using such design factors as type of matrix material, type and modulus of the fibers, orientation of the fibers, and number of layers or thickness of the composite.

Efforts have been made to increase the ability of a bat to rebound a ball efficiently, particularly in a region of the barrel known as the "sweet spot". In the sweet spot, the rebounding effect tends to be greater than at other points along the length of the barrel. The sweet spot of a bat may include much of the length of the barrel. Although the shape of the barrel is not generally altered, the stiffness of the barrel may be manipulated to increase the rebounding effect. However, increasing the stiffness of the barrel often simply involves increasing the amount of material in the barrel. Increasing the amount of material in the barrel tends to increase the weight of the barrel. A heavier bat typically leads to slower swing speeds and less powerful hits.

Therefore, there exists a need in the art for a bat having increased stiffness in the sweet spot while effectively managing weight.

SUMMARY OF THE INVENTION

The invention generally includes a bat having a stiffening layer formed of unidirectional fibers that substantially encircle the barrel of the bat.

In one aspect, the invention provides a bat comprising a stiffening layer comprising a layer of a first composite material having unidirectional fibers, the stiffening layer disposed on a barrel and positioned at a sweet zone of a barrel; and the unidirectional fibers of the composite material oriented substantially orthogonal to a longitudinal axis of the bat.

In another aspect, the barrel comprises a plurality of layers of a second composite material.

In another aspect, the stiffening layer has a shorter length than a barrel length.

In another aspect, the barrel comprises a first wall and a concentric second wall.

In another aspect, each of the first wall and the second wall includes a stiffening layer.

In another aspect, a second stiffening layer is positioned adjacent to the stiffening layer.

In another aspect, the stiffening layer comprises an exterior layer of the barrel.

In another aspect, the invention provides a bat comprising a stiffening layer made of a layer of the composite material having unidirectional fibers, the stiffening layer disposed on the barrel and positioned at the sweet zone of a barrel, and the unidirectional fibers of the composite material oriented to substantially encircle the barrel.

In another aspect, the stiffening layer has a length shorter than a barrel length.

In another aspect, the stiffening layer is an exterior layer of the barrel.

In another aspect, the barrel includes an outermost layer of the barrel.

In another aspect, the outermost layer of the barrel comprises glass fiber.

In another aspect, the stiffening layer comprises a first length spaced apart from a second length.

In another aspect, the stiffening layer and the barrel are made from the same composite material.

In another aspect, the invention provides a bat comprising a barrel comprising a first wall and a concentric second wall, a first stiffening layer comprising a layer of a composite material having unidirectional fibers, the first stiffening layer disposed on the first wall and positioned over a portion of the sweet zone of the barrel, the second stiffening layer comprising a layer of a second composite material having unidirectional fibers, the second stiffening layer disposed on the second wall and positioned over a portion of the sweet zone of the barrel, and the unidirectional fibers of the first stiffening layer and the second stiffening layer oriented to substantially encircle the barrel.

In another aspect, the first wall is configured to move with respect to at least a portion of the second wall.

In another aspect, the first wall and the second wall are at least partially separated by a layer of release film.

In another aspect, the first stiffening layer and the second stiffening layer have different lengths.

In another aspect, the first stiffening layer is an exterior layer of the first wall.

In another aspect, the second stiffening layer is an exterior layer of the second wall.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

A composite bat includes provisions to stiffen a portion of the sweet zone of the barrel. As discussed below, in some embodiments of the invention, this stiffening is achieved by including a layer of unidirectional fibers extending around the circumference of the barrel of the bat.

Figure 1:
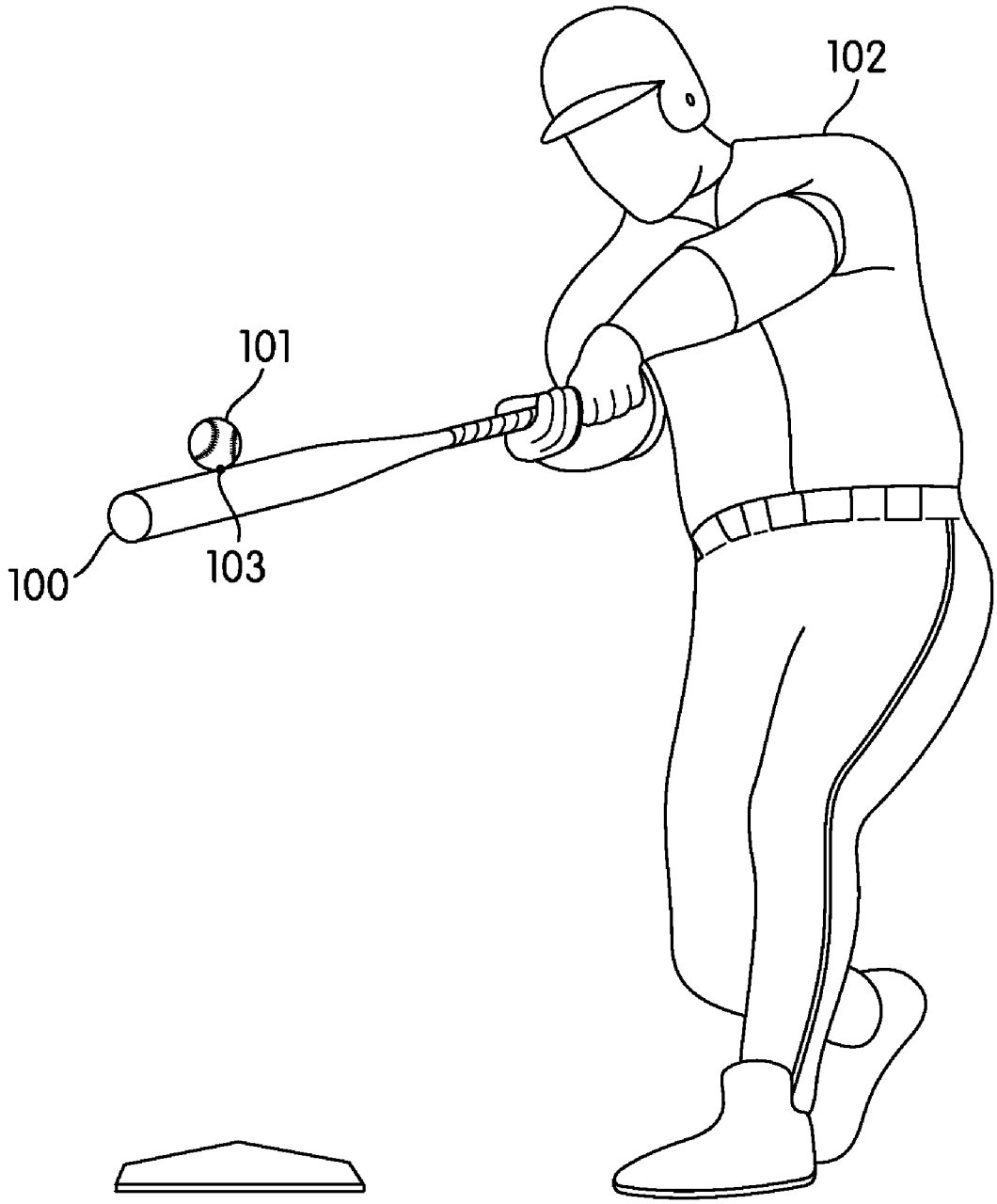
FIG. 1 is a perspective view of an embodiment of a composite bat being used by a player.

FIG. 1 shows a composite bat 100 according to an embodiment of the invention. During play in diamond sports such as softball and baseball, a player 102 makes contact with a ball 101 with composite bat 100 at contact point 103. Once player 102 makes contact with ball 101 at contact point 103, ball 101 rebounds off of bat 100 and is propelled away from bat 100.

Figure 2:
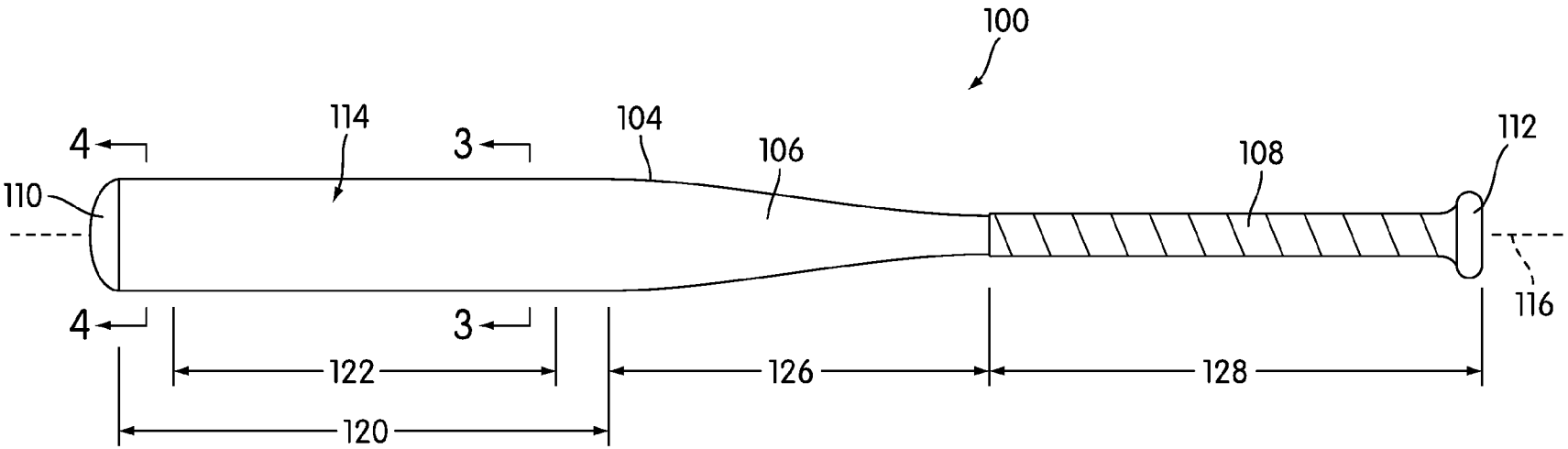
FIG. 2 is a plan view of an embodiment of a composite bat.

As shown in FIG. 2, composite bat 100 generally includes a handle 108 configured to be grasped by player 102 and a barrel 104 configured to contact ball 101. A taper region 106 connects handle 108 and barrel 104. Each portion of composite bat 100 is preferably made from fiber-reinforced materials. In some embodiments, however, any of taper region 106, handle 108, and barrel 104 may be made of another material, such as metal, plastics, or the like.

While player 102 may swing composite bat 100 so that contact point 103 may be at any position along the length of bat 100, statistically players tend to hit ball 101 so that contact point 103 is positioned on barrel 104 in a position commonly known as the "sweet zone" 114. Sweet zone 114 is a portion of barrel 104 in which the rebound of ball 101 loses the least amount of energy after the collision with barrel 104. In other words, ball 101 contacts barrel 104 in sweet zone 114 and is propelled away from barrel 104 efficiently so that ball 101 flies farther and more true than if ball 101 had contacted bat 100 on a point outside of sweet zone 114. Some players and bat manufacturers may define a more specific "sweet spot", also sometimes referred to as the center of percussion. Hitting the ball at this spot is considered by many to produce the best hitting characteristics, and the position of the sweet spot along the length of a bat may vary from bat to bat, depending upon the bat diameter, materials, length, and other factors. For example, a 30-inch solid wood bat dimensioned for use in Little League may have a sweet spot from four to seven inches as measured from the tip of the bat. Sweet zone 114 preferably includes a sweet spot. In some embodiments, sweet zone 114 has a length 122 similar to a barrel length 120. In other embodiments, sweet zone length 122 is less than barrel length 120.

The rebounding of ball 101 from bat 100 depends, in part, on the stiffness of barrel 104. When barrel 104 is more stiff, ball 101 rebounds more efficiently from barrel 104. However, to stiffen the barrel of a bat, typically the barrel is made thicker or stiffening inserts are provided. This increases the weight of barrel, potentially reducing the swing speed of the bat. If the swing speed is reduced, the ball may be hit with less power and travel a decreased distance. Using a composite material stiffening layer, such as layer 132 in the embodiment shown in FIG. 5 and layers 232, 235, and 237 shown the embodiment shown in FIG. 6, allows for tailored stiffening so that the stiffness of the barrel may be increased while managing weight.

Figure 3:
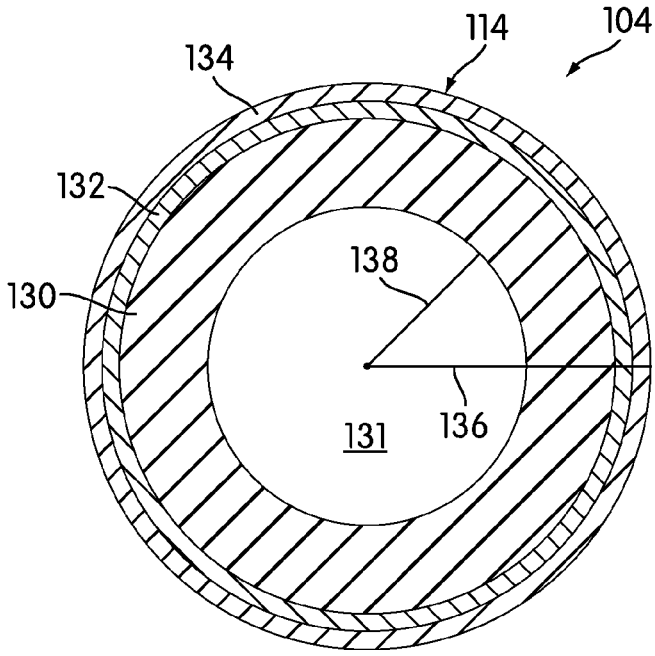
FIG. 3 is a cross-sectional view of the composite bat of FIG. 2, taken along line 3-3 in the region of additional stiffness.
Figure 4:
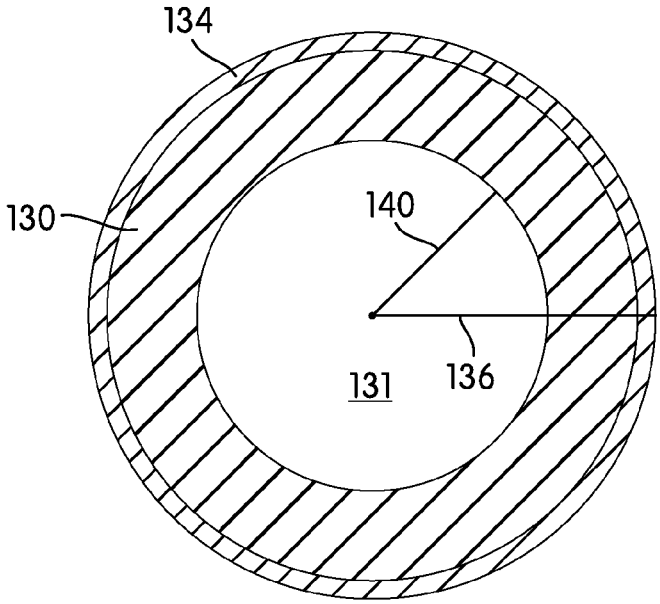
FIG. 4 is a cross-sectional view of the barrel of the composite bat of FIG. 2, taken along line 4-4 outside the region of additional stiffness.
Figure 5:
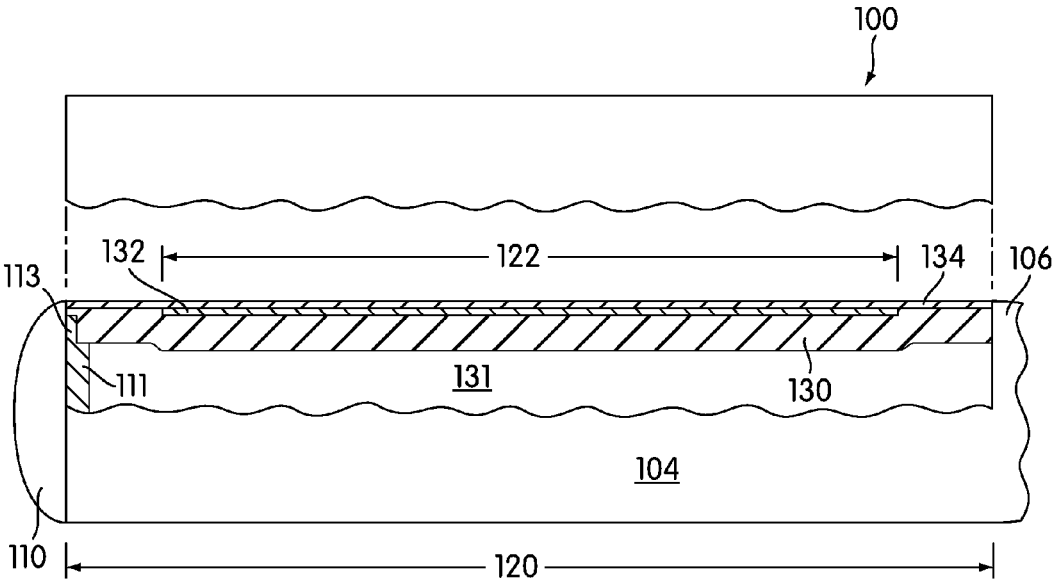
FIG. 5 is a partial cross-sectional view of an embodiment of a composite bat.

In the embodiment shown in FIGS. 2-5, barrel 104 is similar in size, shape, and proportion to conventional bats. Barrel 104, in some embodiments, is an elongated cylindrical member. In other embodiments, barrel 104 may have other shapes, such as having an elliptical cross-sectional shape. In some embodiments, barrel 104 is a walled shell having a hollow core 131, as shown in FIGS. 3-5. In other embodiments, core 131 may be filled, such as with foam or an insert, such as a metal, plastic, or composite material insert.

The wall or walls of barrel 104 may be made of composite materials. In some embodiments, the wall or walls of barrel 104 may be made of a combination of composite materials and other materials, such as metals. In some embodiments, the wall or walls of barrel 104 may be made of more than one type of composite material. Composite materials generally include fibers embedded within a matrix material. The matrix material may be any matrix material known in the art, such as thermoplastic or thermoset polymers. Thermoplastic polymers include ABS, nylon, polyether, and polypropylene. Thermoset polymers include epoxy, polyester, and polyurethane. The fibers may be made of any material known in the art for use as composite material fibers, such as carbon, aramids, glass, metal, and the like. The fibers may be chopped fibers, where each fiber has a relatively short length, or continuous, where each fiber has a length approximately the same as the length of the ply. The fibers may be dry fiber or pre impregnated or "prepreg" fibers. Each fiber has a thickness or modulus, and the fibers used in barrel 104 may have any fiber modulus known in the art.

Barrel 104 may be made using any standard technique, such as lay up, filament winding, RTF, or the like. In one embodiment, barrel 104 may be made by laying up the plies of barrel 104 on a mandrel shaped like core 131. Barrel 104 and mandrel may then be heated in an oven until the matrix cures. The mandrel may then removed from barrel 104 leaving core 131 hollow. In another embodiment, the plies of barrel 104 may be positioned within a male or female mold. An inflatable member such as a bladder may be disposed within the mold so that when the mold is closed, the bladder may be inflated to press the plies against the mold and to form the void for core 131. The mold may then be baked in an oven until the matrix cures. The mold may then be opened and the bladder deflated and removed from barrel 104.

In some embodiments, barrel 104 may be made of a plurality of layers of fiber. Each layer may include a single ply or multiple plies, where each ply is a single fiber in thickness. In some embodiments, each layer includes unidirectional fibers. In other words, those layers have fibers positioned substantially parallel to each other within the layer. Each layer may then positioned on barrel 104 so that all of the fibers of the layer form an angle with respect to a longitudinal axis 116 of bat 100. In one embodiment, barrel 104 may be structured as described in U.S. Pat. No. 7,699,725, the entirety of which is incorporated herein by reference thereto.

Figure 8:
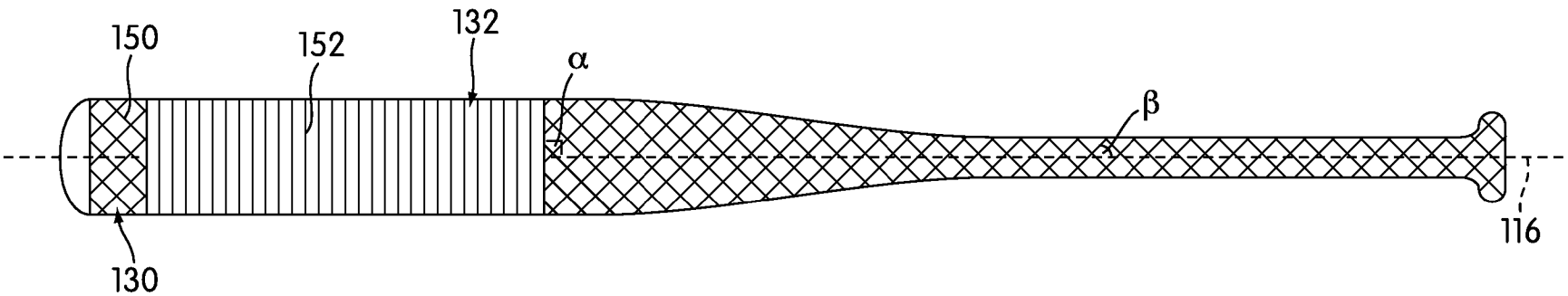
FIG. 8 is a schematic plan view of an embodiment of a composite bat showing the directions of the fibers in the stiffening layer and in the remainder of the composite bat.

Bat 100 includes a stiffening layer 132, as shown in FIGS. 3-5. Stiffening layer 132 in some embodiments may be an additional layer of composite material attached to a main composite body 130 of a wall of barrel 104. FIGS. 3-5 show an embodiment of a single-walled barrel 104. Stiffening layer 132 preferably is made of a composite material including unidirectional fibers. As shown in FIG. 8, the stiffening layer fibers 152 may be oriented at a first angle α with respect to a longitudinal axis 116 of bat 100. Main body fibers 150 may be oriented at a second angle β with respect to longitudinal axis 116. Preferably, first angle α is different from second angle β. First angle α is preferably orthogonal or substantially orthogonal to longitudinal axis 116. In other words, stiffening layer fibers 152 are preferably positioned at a 90-degree angle or a substantially 90-degree angle with respect to longitudinal axis 116. Manufacturing limitations may not permit consistently forming a perfect 90-degree angle, so first angle α may range from about 85 degrees to about 95 degrees in some embodiments. Second angle β is preferably less than 90 degrees. In some embodiments, second angle β may range from 0 degrees to about 75 degrees. If multiple layers are used to form main composite body 130, then the fibers in each layer may form a different angle with respect to longitudinal axis 116.

Stiffening layer 132 is preferably positioned within sweet region 122. Although shown as a single unit traversing substantially the entire length 122 of sweet region 114, in other embodiments, stiffening layer 132 may be shorter than sweet region length 122. Additionally, stiffening layer 132 may include several smaller units positioned along sweet region length 122, as shown and described in the embodiment shown in FIGS. 6 and 7.

Additionally, stiffening layer 132 is preferably positioned so that stiffening layer 132 may form an exterior layer of barrel 104. Stiffening layer 132 may, in some embodiments, form the outermost layer of barrel 104. However, in other embodiments, stiffening layer 132 may be covered by or substantially covered by one or more additional layers so that stiffening layer 132 forms an exterior layer of barrel 104 but not the outermost layer of barrel 104. For example, in the embodiment shown in FIGS. 3-5, outermost layer 134 covers or substantially covers stiffening layer 132. In some embodiments, outermost layer 134 may be another layer of a similar composite material to that of stiffening layer 132. In some embodiments, outermost layer 134 may be another composite material, such as fiberglass or a composite layer made of unidirectional glass fibers having any orientation with respect to the longitudinal axis of the bat, such as being axial or longitudinal fibers. In some embodiments, outermost layer 134 may include a coating, such as a sealant or a decorative layer. The sealant may protect stiffening layer and main composite body 130 from moisture or the like. The decorative layer may include paint, logo appliques, such as decals, stickers, or the like, and/or a clear coat.

Stiffening layer 132 stiffens barrel 104 so that barrel 104 may rebound ball 101 more efficiently. Stiffening layer 132 increases the stiffness of barrel 104 by generally increasing the thickness of barrel 104. As shown in FIGS. 3 and 4, barrel 104 includes an outer diameter 136, generally measured from a center of core 131 to the outside surface of main composite body 130. Barrel 104 includes a first inner diameter 138 in the region of barrel 104 including stiffening layer 132, as shown in FIG. 3. First inner diameter 138 is generally measured from a center of core 131 to an inside surface of barrel 104. Barrel 104 includes a second inner diameter 140 in the region of barrel 104 not including stiffening layer 132, as shown in FIG. 4. The inclusion of stiffening layer 132 increases the thickness of barrel 104 so that first inner diameter 138 is less than second inner diameter 140. While this thickness differential is exaggerated in the figures, typically, the difference between first inner diameter 138 and second inner diameter 140 is generally small, ranging from less than a millimeter to about 5 millimeters.

Stiffening layer 132 also increases the stiffness of barrel 104 and the rebound response of barrel 104 due to the orientation of stiffening layer fibers 152 (shown in FIG. 8). In some embodiments, stiffening layer 132 is positioned as an exterior layer of barrel 104. Barrel 104 is a shell, so when barrel 104 collides with ball 101, barrel 104 experiences different forces on the exterior of the shell in the impact region than are transmitted to the interior of the shell. The exterior of the shell tends to experience compression forces while the interior of the shell tends to experience tension forces. Because stiffening layer fibers are configured to essentially form hoops around the circumference of or encircle barrel 104, stiffening layer fibers 152 are more difficult to compress than fibers having different orientations. In other words, the hoop-like orientation of fibers 152 positioned at or near the outer surface of the shell of barrel 104 resist deformation upon impact more than do fibers having other orientations. Therefore, the position of stiffening layer 132 as an exterior layer of barrel 104 and the orientation of stiffening layer fibers 152 orthogonal to longitudinal axis 116 increase the effective stiffness of barrel 104 more than if a layer of similar thickness but having differently-oriented fibers were added to barrel.

Other sections of the bat may also be configured to accommodate specific design points. Referring to FIGS. 1 and 2, cap 110 operates to close one end of bat 100. Cap 110 may be made of any material capable of being associated with barrel 104, such as metals, plastics, composite materials, or the like. Cap 110 may be manufactured in a number of different ways. In one embodiment, cap 110 may be created by folding over barrel 104 to close off barrel 104. In other embodiments, cap 110 may be constructed separately and attached to barrel 104. In such an embodiment, a portion 113 of cap 110 may be inserted inside barrel 104. The remainder of cap 110 may reside outside of and adjacent to barrel 104. In such an embodiment, cap 110 may be pressed against barrel 104 until cap 110 abuts at least a portion of barrel 104. Cap 110 may then be associated with barrel 104 using any method known in the art, such as with an adhesive, with another type of mechanical fastener, or by welding. The association of cap 110 with barrel 104 may be direct or indirect. In the association is indirect, an intermediate structural element may be positioned between cap 110 and barrel 104.

The shape and size of cap 110 may vary in different embodiments. The shape and size of cap 110 may be any shape or size. Preferably, some surface of cap 110 contacts some surface of barrel 104 so the two may be attached. It is also preferable that the diameter of cap 110 may not be larger than the diameter of barrel 104. In addition, the portion of cap 110 that resides outside of barrel 104 may include a rounded or beveled edge. In some embodiments, cap 110 is sized and dimensioned to completely close off the interior of barrel 104.

Handle 108 may be used by a player to grip composite material bat 100 when a player is receiving pitches or carrying composite material bat 100 from one location to another. In different embodiments, the size and shape of handle 108 may vary. The size and shape of handle 108 may be any size and shape that allows the user to comfortably grip handle 108 and swing composite material bat 100. In some embodiments, handle 108 may be cylindrically shaped or have a frustoconical shape. The length of handle 108 may be one-third the length L of composite material bat 100 and one-third the diameter of barrel 104. However, in other embodiments, handle 108 may be of any shape or size known in the art.

Handle 108 may be made of any material known in the capable of being associated with composite material layered barrel 104. In some embodiments, barrel 104 and handle 108 may be formed as a single unit. In other embodiments, handle 108 may be formed separately from barrel 104 and associated with barrel 104 using any method known in the art. In one method, handle 108 may be configured so that a portion of handle 108 may be press fitted or otherwise inserted into the hollow center of barrel 104. Handle 108 may then be affixed, such as with an adhesive or by welding to barrel 104. In other embodiments, handle 108 is configured to abut barrel 104 so that handle 108 may be secured to barrel 104 using any method known in the art, such as with an adhesive. Handle 108 may be directly associated with barrel 104 or indirectly associated with barrel 104, such as by including an intermediate structure between handle 108 and barrel 104.

In some embodiments, handle 108 may be configured with a high-friction coating or a cushioning coating for a more secure and/or comfortable grip. For example, an elastomeric sleeve may be snugly fitted to handle 108. In another embodiment, tape may be removably affixed to handle 108.

As cap 110 operates to close one end of bat 100, base 112 operates to close the opposite end of bat 100. Base 112 may be manufactured in a number of different ways. In one embodiment, base 112 may be created by folding over handle 108 to close off handle 108. In other embodiments, base 112 may be constructed separately and attached to handle 108. In such an embodiment, a portion of base 112 may be inserted inside handle 108. The remainder of base 112 may reside outside of and adjacent to handle 108. The shape and size of base 112 may vary in different embodiments. Preferably, some surface of base 112 contacts some surface of handle 108 so the two may be attached. In some embodiments, the diameter of base 112 may be larger than the diameter of handle 108. Preferably, the portion of base 112 that resides outside of handle 108 may be disc-shaped. However, the shape and size of base 112 may be any shape or size. The association of base 112 with handle 108 may be direct or indirect. If the association is indirect, then an intermediate structure may be positioned between base 112 and handle 108.

Figure 6:
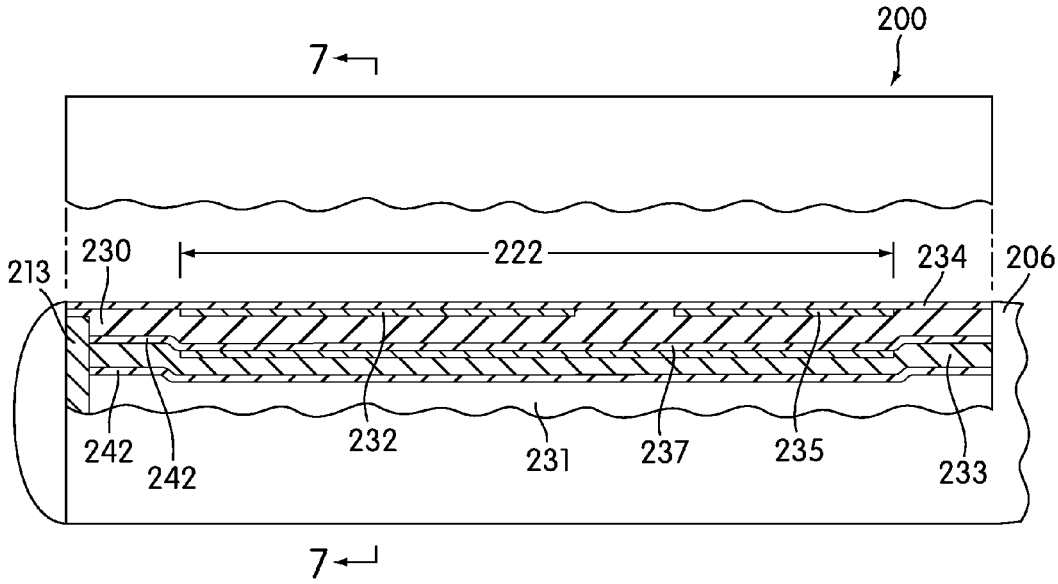
FIG. 6 is a partial cross-sectional view of an embodiment of a double-walled composite bat.
Figure 7:
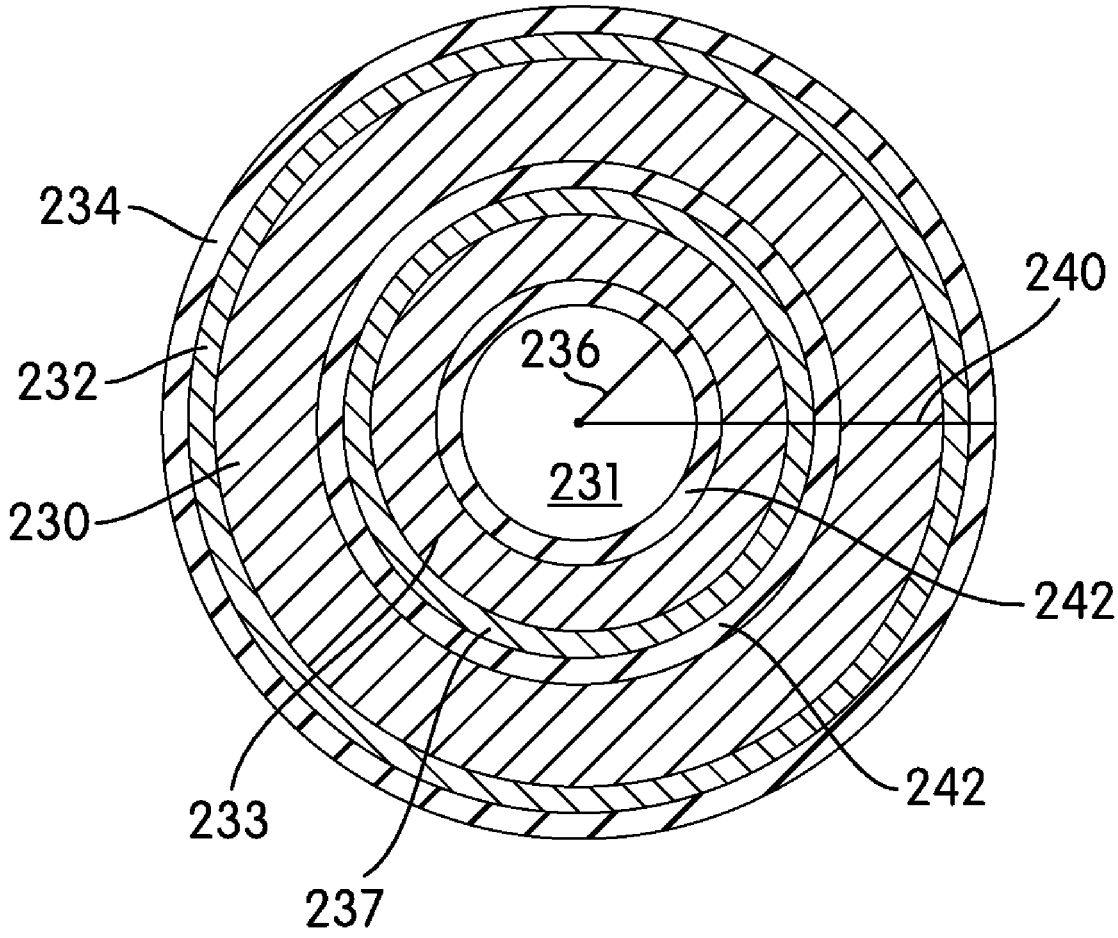
FIG. 7 is a cross-sectional view of the barrel of the double-walled composite bat of FIG. 6, taken along line 7-7.

FIGS. 6-7 show an embodiment of a multi-walled barrel 204 having stiffening plies 232, 235, and 237 in a sweet zone 214 of barrel 204. Similar to barrel 104 in many respects, multi-walled barrel 204 may contain two or more walls, though typically a multi-walled barrel would contain two or three concentric walls. Preferably, each wall of barrel 204 is configured to move with respect to at least a portion of the other wall or walls of barrel 204. In other words, a wall may abut an adjacent wall but may not be adhered, connected, or attached to at least a portion of the adjacent wall. In order to facilitate manufacturing, a layer of release film may be positioned between adjacent walls so that the composite materials of a first wall do not fuse to the composite material of the second wall during the curing process. The overall thickness of multi-walled barrel 204 may be greater than the thickness of a single-walled barrel, such as barrel 104 described above.

FIG. 7 shows a cross-section of a multi-walled barrel configuration including stiffening layers. The center of barrel 204 is a hollow core 231. Core 231 may remain empty or may be filled with a material, such as a foam or an elastomeric material. An inner wall of barrel 204 is formed from a first main composite body 233 and a first stiffening layer 237. An outer wall of barrel 204 is formed from a second main composite body 230 and a second stiffening layer 232. An outermost layer 234 may also be provided.

Release film 242 may be used to separate the inner wall from the outer wall. Additionally, in some embodiments, a layer of release film may be provided between first main composite body 233 and hollow core 231 so that barrel 204 may be more easily extracted from a mandrel during manufacture. Release film 242 may be any type of release film known in the art that is capable of preventing inner wall from fusing with or bonding to the outer wall during the curing process. In some embodiments, release film 242 may be blue release film. In other embodiments, release film 242 may be a thin sheet of a polymer, such as Teflon®.

Because release film 242 is positioned between the inner wall and the outer wall, the inner wall layers may move and flex with respect to the outer wall layers. This alters the ability of the shell to transfer forces and stresses from the outer wall to the inner wall. Consequently, each wall preferably includes a stiffening layer having unidirectional fibers oriented axially, i.e., oriented orthogonally to a longitudinal axis of barrel 204.

Additionally, preferably each stiffening layer forms an exterior layer or portion of an exterior layer of the wall to which that stiffening layer is attached. For example, inner stiffening layer 237 forms an exterior layer of the inner wall and first outer stiffening layer 232 and second outer stiffening layer 235 form portions of an exterior layer of the outer wall. As discussed above with respect to barrel 104, an exterior layer need not be the outermost layer. For example, first and second outer stiffening layers 232 and 235 are covered or substantially covered by an outermost layer 234, which is similar to outermost layer 134 discussed above. Although the inner layer should not experience the same magnitude of compression forces from an impact as the outer layer experiences, because the inner layer may move with respect to the outer layer, the exterior layers of the inner layer may experience significant compression forces. Therefore, providing stiffening layer 237 having axial fibers advantageously increases the stiffness for the inner layer.

Inner stiffening layer 237 is shown in FIG. 6 as traversing almost the entire sweet region length 222. However, in other embodiments, stiffening layer 237 may be shorter or longer than sweet region 222. Stiffening layer 237 is similar to stiffening layer 132 discussed above, in that stiffening layer 237 is preferably made of a composite material having unidirectional fibers oriented orthogonally or substantially orthogonally to a longitudinal axis of barrel 204.

Similarly, first and second outer stiffening layers 232 and 235 are shown in FIG. 6 as traversing only a portion of the length of sweet region 222. In the embodiment shown, first outer stiffening layer 232 is spaced apart from second outer stiffening layer 235 along the length of barrel 204. However, first outer stiffening layer 232 and second outer stiffening layer 235 are positioned on the same exterior layer of barrel 204. In other embodiments, first outer stiffening layer 232 may be on a different exterior layer than second outer stiffening layer 235. In other embodiments, first outer stiffening layer 232 may not be a separate unit from second outer stiffening layer 235. First and second stiffening layers 232 and 235 are similar to stiffening layer 132 discussed above, in that first and second stiffening layers 232 and 235 are preferably made of a composite material having unidirectional fibers oriented orthogonally or substantially orthogonally to a longitudinal axis of barrel 204.

Similarly to barrel 104, stiffening layers 232, 235, and 237 increase the stiffness of barrel 204 and allow a more efficient rebound than if barrel 204 did not include stiffening layers 232, 235, and 237. The additional thickness of barrel 204 due to stiffening layers 232, 235, and 237 generally increase the stiffness of barrel 204 in the sweet region. Additionally, because the fibers of stiffening layers 232, 235, and 237 form hoops around or encircle barrel 204, the fibers of stiffening layers 232, 235, and 237 also resist compression due to impacts from a ball. Therefore, the increased stiffness from stiffening layers 232, 235, and 237 is greater than the increased stiffness of a similarly thick layer having fibers oriented differently. Therefore, the weight of the bat may be managed while increasing the thickness of the wall or walls of the shell of barrel 204 in selected regions.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A bat comprising:

a handle portion configured to be grasped by a player and a barrel, wherein the barrel has a first wall and a concentric second wall, wherein the first wall comprises a first group of layers and the second wall comprises a second group of layers, and wherein a release film layer is disposed between the first wall and the second wall;

the first wall having a first axial portion and a second axial portion;

the first wall having an outermost layer and a first composite body, wherein the outermost layer contacts the first composite body along the first axial portion;

wherein the first composite body includes a first wall innermost layer having unidirectional fibers positioned at a first low angle with respect to the longitudinal axis of the bat and a first wall outer layer having unidirectional fibers positioned at a first high angle with respect to the longitudinal axis of the bat, wherein the first wall outer layer is positioned concentrically outward of the first wall innermost layer so that the first wall outer layer surrounds the first wall innermost layer, and wherein a first wall series of layers including at least three layers positioned between the first wall innermost layer and the first wall outer layer, wherein each layer in the first wall series of layers includes unidirectional fibers at angles different from the first low angle and the first high angle, and wherein the angles of the unidirectional fibers in any two successive layers of the first wall series progress by about 15 degrees;

the first wall having a first stiffening layer disposed between the outermost layer and the first composite body along the second axial portion; wherein an outer surface of the first stiffening layer contacts the outermost layer and wherein an inner surface of the stiffening layer is attached to the first composite body;

wherein the first composite body has a first inner diameter generally corresponding to the first axial portion and a second inner diameter generally corresponding to the second axial portion; and wherein the first outer stiffening layer displaces the first composite body radially inward along the second axial portion so that the second inner diameter of the outer composite body is less than the first inner diameter of the outer composite body;

the second wall having a third axial portion and a fourth axial portion;

the second wall having a second composite body, wherein the second composite body contacts the release film layer along the third axial portion;

wherein the second composite body includes a second wall innermost layer having unidirectional fibers positioned at a second low angle with respect to the longitudinal axis of the bat and a second wall outer layer having unidirectional fibers positioned at a second high angle with respect to the longitudinal axis of the bat, wherein the second wall outer layer is positioned concentrically outward of the second wall innermost layer so that the second wall outer layer surrounds the second wall innermost layer, and wherein a second wall series of layers including at least three layers positioned between the second wall innermost layer and the second wall outer layer, wherein each layer in the second wall series of layers includes unidirectional fibers at angles different from the second low angle and the second high angle, and wherein the angles of the unidirectional fibers in any two successive layers of the second wall series progress by about 15 degrees;

the second wall having a second stiffening layer disposed between the release film layer and the second composite body along the fourth axial portion; wherein a second outer surface of the second stiffening layer contacts the release film layer and wherein an inner surface of the second stiffening layer is attached to the second composite body;

wherein the second composite body has a third inner diameter generally corresponding to the third axial portion and a fourth inner diameter generally corresponding to the fourth axial portion; and wherein the second stiffening layer displaces the second composite body radially inward along the fourth axial portion so that the fourth inner diameter of the second composite body is less than the third inner diameter of the second composite body; and wherein the second axial portion generally aligns with the fourth axial portion.

2. The bat according to claim 1, wherein at least one of the first stiffening layer and the second stiffening layer comprises a plurality of axially spaced stiffening portions.

3. The bat according to claim 1, wherein the release film generally follows the contours of the outer composite body.

4. The bat according to claim 3, wherein the release film has a first diameter generally corresponding to the first axial portion and a second diameter generally corresponding to the second axial portion; and wherein the release film extends radially inward from the first axial portion to the second axial portion so that the second diameter of the release film is less than the first diameter of the release film.

5. The bat according to claim 1, wherein the first stiffening layer comprises a first composite material having a first set of unidirectional fibers, wherein the first stiffening layer is attached to the composite body by curing.

6. The bat according to claim 1, wherein the first low angle is about 0 degrees.

7. The bat according to claim 1, wherein the high angle is about 90 degrees.

8. The bat according to claim 1, wherein the first composite body extends radially inward along the second axial portion, and wherein the stiffening layer deflects the composite body so that the composite body is stepped between the first axial portion and the second axial portion so that the second inner diameter is different from the first inner diameter, and wherein the second inner diameter is less than about 5 millimeters different from the first inner diameter.

9. A bat comprising:

a handle portion configured to be grasped by a player and a barrel, wherein the barrel has a first wall and a concentric second wall, wherein the first wall comprises a first group of layers and the second wall comprises a second group of layers, and wherein a release film layer is disposed between the first wall and the second wall;

the barrel having a first axial portion, a second axial portion and a third axial portion, the second axial portion being disposed between the first axial portion and the third axial portion;

the second axial portion generally corresponding to a sweet portion of the barrel;

the first wall having an outermost layer and a first composite body;

wherein the outermost layer contacts the first composite body along the first axial portion and the third axial portion;

the first wall having a first stiffening layer disposed between the outermost layer and the first composite body along the second axial portion; wherein an outer surface of the first stiffening layer contacts the outermost layer and wherein an inner surface of the stiffening layer is attached to the first composite body;

wherein the first composite body has a first inner diameter generally corresponding to the first axial portion, a second inner diameter generally corresponding to the second axial portion and a third inner diameter generally corresponding to the third axial portion;

wherein a portion of the first composite body is deflected radially inward along the second axial portion to accommodate the outer stiffening layer, and wherein the second inner diameter of the outer composite body is less than the first inner diameter of the outer composite body and the third inner diameter of the outer composite body;

the second wall having a second composite body; wherein the second composite body contacts the release film layer along the first axial portion and the third axial portion;

the second wall having a second stiffening layer disposed between the release film layer and the second composite body along the second axial portion; wherein an outer surface of the second stiffening layer contacts the release film layer and wherein an inner surface of the stiffening layer is attached to the second composite body;

wherein the second composite body has a fourth inner diameter generally corresponding to the first axial portion, a fifth inner diameter generally corresponding to the second axial portion and a sixth inner diameter generally corresponding to the third axial portion;

wherein a portion of the second composite body is deflected radially inward along the second axial portion to accommodate the second stiffening layer, and wherein the fifth inner diameter of the second composite body is less than the fourth inner diameter of the second composite body and the sixth inner diameter of the second composite body.

10. The bat according to claim 9, wherein at least one of the first stiffening layer and the second stiffening layer comprises a plurality of axially spaced stiffening portions.

11. The bat according to claim 9, wherein the first composite body includes a first wall innermost layer having unidirectional fibers positioned at a first low angle with respect to the longitudinal axis of the bat and a first wall outer layer having unidirectional fibers positioned at a first high angle with respect to the longitudinal axis of the bat, wherein the first wall outer layer is positioned concentrically outward of the first wall innermost layer so that the first wall outer layer surrounds the first wall innermost layer, and wherein a first wall series of layers including at least three layers positioned between the first wall innermost layer and the first wall outer layer, wherein each layer in the first wall series of layers includes unidirectional fibers at angles different from the first low angle and the first high angle, and wherein the angles of the unidirectional fibers in any two successive layers of the first wall series progress by about 15 degrees.

12. The bat according to claim 9, wherein the second composite body includes a second wall innermost layer having unidirectional fibers positioned at a second low angle with respect to the longitudinal axis of the bat and a second wall outer layer having unidirectional fibers positioned at a second high angle with respect to the longitudinal axis of the bat, wherein the second wall outer layer is positioned concentrically outward of the second wall innermost layer so that the second wall outer layer surrounds the second wall innermost layer, and wherein a second wall series of layers including at least three layers positioned between the second wall innermost layer and the second wall outer layer, wherein each layer in the second wall series of layers includes unidirectional fibers at angles different from the second low angle and the second high angle, and wherein the angles of the unidirectional fibers in any two successive layers of the second wall series progress by about 15 degrees.

13. The bat according to claim 9, wherein the second inner diameter is less than about 5 millimeters different from the first inner diameter.

* * * * *